United States Patent [19]

Hanlon

[11] Patent Number: 4,620,652

[45] Date of Patent: Nov. 4, 1986

[54] THREADED SPOOL STORAGE CONTAINER APPARATUS AND METHOD

[75] Inventor: William S. Hanlon, Scottsdale, Ariz.

[73] Assignee: Design Inceptions, Inc., Phoenix, Ariz.

[21] Appl. No.: 785,866

[22] Filed: Oct. 9, 1985

[51] Int. Cl.[4] ..... A41H 31/00

[52] U.S. Cl. ..... 223/107; 206/394; 211/70; 211/170; 312/72; 312/97.1

[58] Field of Search ..... 223/106, 107; 312/97.1, 312/72; 242/134, 137; 206/391, 394; 211/70, 168, 170; 221/188, 189

[56] References Cited

U.S. PATENT DOCUMENTS

| | | | |
|---|---|---|---|
| 1,283,024 | 10/1918 | Armstrong | 223/106 |
| 1,808,658 | 6/1931 | Hosier | 221/189 |
| 2,537,940 | 1/1951 | Peake | 223/107 |
| 2,673,669 | 3/1954 | Hawkins | 223/107 |
| 3,127,017 | 3/1964 | Dower | 206/391 X |
| 3,442,394 | 5/1969 | McCune et al. | 206/394 X |

FOREIGN PATENT DOCUMENTS

| | | | |
|---|---|---|---|
| 3003889 | 8/1981 | Fed. Rep. of Germany | 206/394 |

*Primary Examiner*—Werner H. Schroeder
*Assistant Examiner*—Andrew M. Falik
*Attorney, Agent, or Firm*—Harry M. Weiss & Associates

[57] ABSTRACT

A threaded spool storage apparatus having a plurality of transparent and rotatable cylindrical containers suitable for accommodating a plurality of multi-colored threaded spools is disclosed. Each cylindrical container is suitable for being removably mounted on an adjustable arm operably coupled to a base member means for accommodating thereto a plurality of lever means for operably manipulating the containers either outwards or inwards to permit thereto the storage, retrieval and replacement of the threaded spools. Moreover, a back portion member means is provided for bracing said containers. Preferably, the plurality of containers are arranged proximately along a horizontal plane; although, if desired, the plurality of containers may be arranged proximately adjacent from each other along a vertical plane suitable for sturdily mounting onto a side of a wall or on a horizontal base means.

8 Claims, 5 Drawing Figures

THREADED SPOOL STORAGE CONTAINER APPARATUS AND METHOD

BACKGROUND OF THE INVENTION

1. Field of the Invention

This invention generally relates to a concept of providing a plurality of visual and rotatable containers capable of storing a plurality of spools having threads accommodated thereto. Each of the plurality of containers is preferably circular in shape and operably mounted adjacent to each other. Moreover, each of the plurality of containers is suitable for being moved forwardly to allow retrieval of empty spools or replacement thereof with threaded spools; and backwardly to permit storage therein of said threaded spools. Further, each of said circular container is made of clear and transparent plastic to allow visual determination of the condition of the plurality of threaded spools inside each of said circular container and to preferably preserve the unique and distinct colors of each of the threads stored therein.

2. Description of the Relevant Art

There has been a substantial need for efficiently and aesthetically storing a plurality of threaded spools. The threaded spools are stored for the purpose of avoiding the frequent loss of threaded spools which can be significantly frustrating and time consuming when needed and rapidly locating threads of desired colors for specific uses in sewing. Accordingly, apparatuses were devised for providing threaded spool containers. As in U.S. Pat. No. 1,467,352 filed by W. W. Bolls on Mar. 14, 1922 and issued on Sept. 11, 1923 wherein a display container suitable for accommodating articles, including threaded spools therein, for easy inspection or removal of said articles upon easy rotation of said container is disclosed. Here, however, a mere plurality of compartmentalized sections integral to the apparatus would preclude efficient use when used in a position other than as shown for use as a cover protector. Other features have been embodied in various sewing kits having a plurality of variegated members incorporated therein for securing a plurality of threaded spools (as disclosed, e.g., in U.S. Pat. No. 2,537,940 filed by M. B. Peake on Mar. 18, 1946 and issued on Jan. 9, 1951; U.S. Pat. No. 2,249,980 filed by J. H. Reichart on Aug. 20, 1938 and issued on July 22, 1941; U.S. Pat. No. 2,646,908 filed on June 22, 1950 by E. K. Madan and issued on July 28, 1953; and U.S. Pat. No. 2,923,451 filed on Oct. 7, 1955 by L. D. Hokerk and issued on Feb. 2, 1960). Here, however, what is disclosed in each of the above-cited patents is a unitary sewing kit unsuitable for rotatable coupling at a generally vertical position in series into a plurality of adjustable storage members. Accordingly, the above-mentioned patents, singly or in combination, do not in any way relate to remotely suggest the structure, cooperation of parts, result or advantages of Applicant's invention. Another embodiment of a threaded spool storage apparatus has been illustrated in U.S. Pat. No. 547,736 filed on May 23, 1895 by J. Notkin and issued on Oct. 8, 1895. In the Notkin thread and needle device, the container used as a safe is an upstanding cylindrical member having a plurality of smaller cylinders and a magnet incorporated therein for storing threaded spools and unused needles, respectively. Here, however, not only are the threaded spools stationary, the container is non-movable thereby significantly lacking in the ease in which the threaded spools may be retrieved and replaced. An improvement of storing a plurality of cylindrical containers for housing a plurality of threaded spools was devised in U.S. Pat. No. 3,452,879 filed by N. A. Guarino on Apr. 19, 1967 and issued on July 1, 1969. Here, significant disadvantage exists whereby each cylindrical container must be removed from the cabinet shelf when necessary to retrieve and remove a specific threaded spool. Moreover, the likelihood of a container full of threaded spools being lost or misplaced is significantly increased absent any means provided therein to secure each of said container yet, at the same time, providing easy access to the threaded spools housed therein. Accordingly, there is a substantial need to avoid the above-mentioned problems existing with previously patented apparatuses by providing thereby the present invention.

In the present invention, a plurality of threaded spools are housed within transparent and rotatable mounting onto adjustable arms for easy and efficient retrieval of any of the desired threads housed therein.

It is therefore an object of the present invention to provide an improved threaded spool storage apparatus and method suitable for providing a plurality of transparent and rotatable containers for housing a plurality of threaded spools, and preferably suitable for precluding or at the least, decreasing the fading process or discoloration of the multi-colored threads of the spools accommodated therein.

It is another object of the present invention to provide an improved threaded spool storage apparatus and method suitable for removably mounting said transparent and rotatable containers onto the plurality of adjustable arms to allow easy access and retrieval of desired threaded spools housed therein.

It is yet another object of the present invention to provide an improved threaded spool storage apparatus and method having a preferably rigid back portion means for bracing said plurality of cylindrical containers.

It is yet another object of the present invention to provide an improved threaded spool storage apparatus and method having a base member means suitable for accommodating a plurality of levers operably connected to the plurality of adjustable arms for moving the plurality of containers inwardly or outwardly for retrieving and replacing the plurality of threaded spools housed therein.

It is yet a further object of the present invention to provide an improved threaded spool storage apparatus and method which can be easily and economically manufactured, yet sturdy in construction and highly efficient in operation.

It is yet a further object of the present invention to provide an improved threaded spool storage apparatus and method which is constructed with extreme simplicity, embodying relatively simple parts, and therefore capable of being retailed for a low price, long lasting in use, and extremely convenient to use.

SUMMARY OF THE INVENTION

The aforementioned and other objects of the present invention are accomplished by providing a highly economical threaded spool storage apparatus having a plurality of transparent and rotatable cylindrical containers suitable for accommodating a plurality of multi-colored threaded spools. Each cylindrical container is suitable for being removably mounted on an adjustable arm operably coupled to a base member means for accommodating thereto a plurality of lever means for operably manipulating the containers either outwards or inwards to permit thereto the storage, retrieval and replacement of the threaded spools. Moreover, a back portion member means is provided for bracing said containers. Preferably, the plurality of containers are arranged proximately along a horizontal plane; although, if desired, the plurality of containers may be arranged proximately adjacent from each other along a vertical plane suitable for sturdily mounting onto a side of a wall or on a horizontal base means.

These and other features of the invention will be understood upon reading of the following description along with the drawings.

DESCRIPTION OF THE PREFERRED EMBODIMENT

Figure 1:
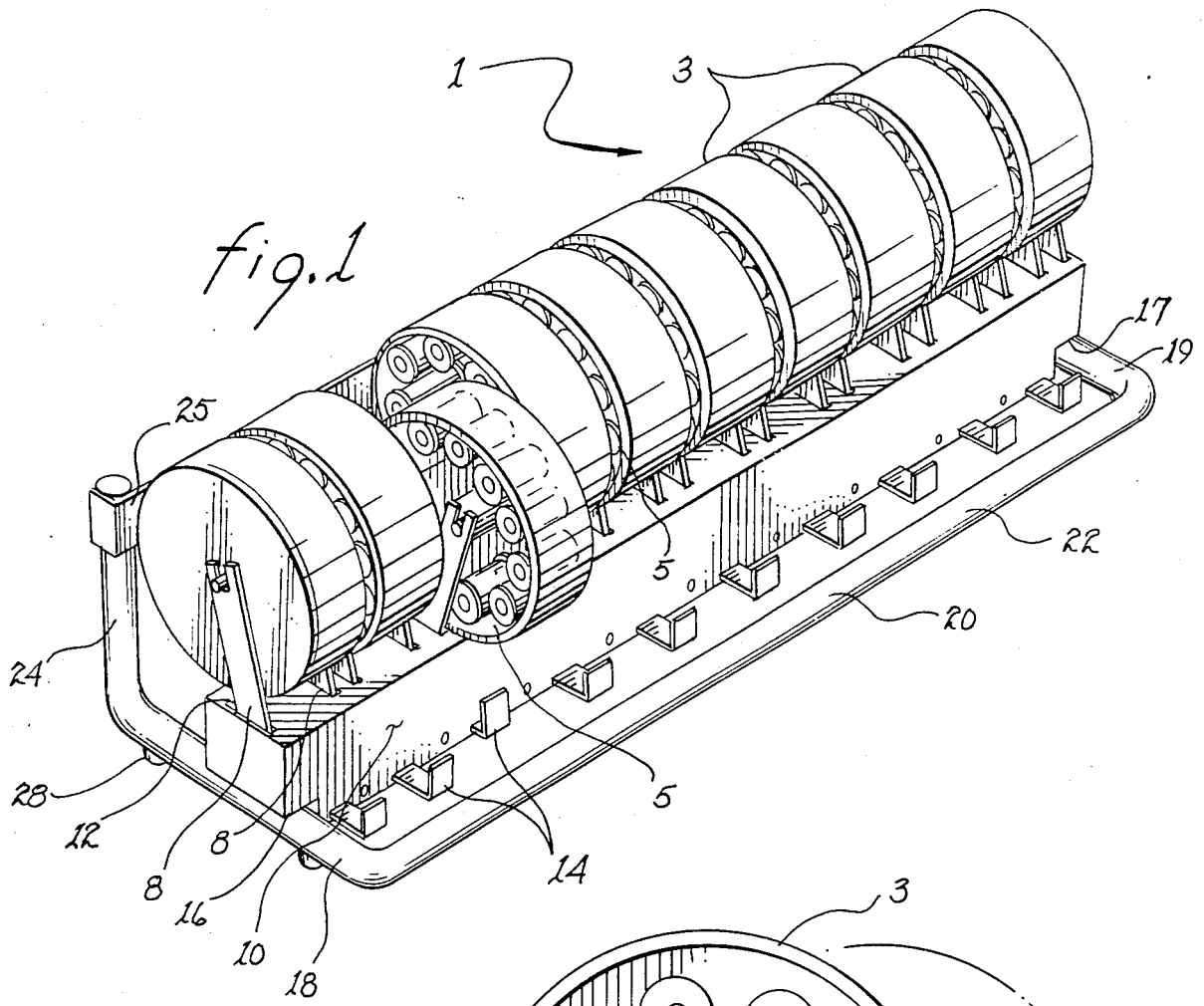
FIG. 1 is a perspective view of an improved threaded spool storage container apparatus of the present invention.

FIG. 1 is a perspective view of an improved threaded spool storage container apparatus, generally designated by reference numeral 1, removably mounting thereon a plurality preferably cylindrical containers 3 for housing therein a plurality of threaded spools 5. The containers 3 are preferably made out of clear or transparent plastic or acrylic to allow visibility through said containers 3 for determining the necessity of retrieval of any desired threaded spools 5 and replacements thereof. Each container 3 is removably mounted on at least a pair of adjustable arm members 8. A base member 10 has a plurality of preferably elongated apertures 12 passing therethrough for accommodating thereto said adjustable arm members 8. At least a pair of adjustable arm members 8 are operably coupled to an adjustable lever member means 14 for inwardly and outwardly moving in at least one direction, the container 3 for storing and retrieving the threaded spools 5 therein. The base member means 10 is braced at each end bottom portion 16, 17 thereto by a bottom piece member 20, having side members 18, 19, which is preferably made out of steel or hard plastic. The bottom piece member 20 has a front portion 22 extending along the length of the base member means 10 therethroughout for providing stability. The bottom piece member 20 further has at least a pair of back portions 24, each vertically and integrally extending therefrom each of the side members 18, 19 of the bottom piece member 20. Both the front 22 and back 24 portions are preferably integral thereto said side members 18, 19. Each of the back portions 24 of the bottom piece member 20 has coupled thereto a plate member means 25 extending along the abutting plurality of containers 3 for bracing thereto said containers 3 when in storing position. Each of the side members 18, 19 has at least two support member means 28, preferably made out of rubber or soft, yet sturdy and durable material, for preventing direct contact of the bottom piece member 20 from a support medium (not shown) which may be made of soft material, such as wood or the like. The arm members 8, and lever member means 14 are preferably made of metal, hard plastic or the like while the base member means 10 may be made out of a thin-walled metallic, or hard plastic material.

Figure 2:
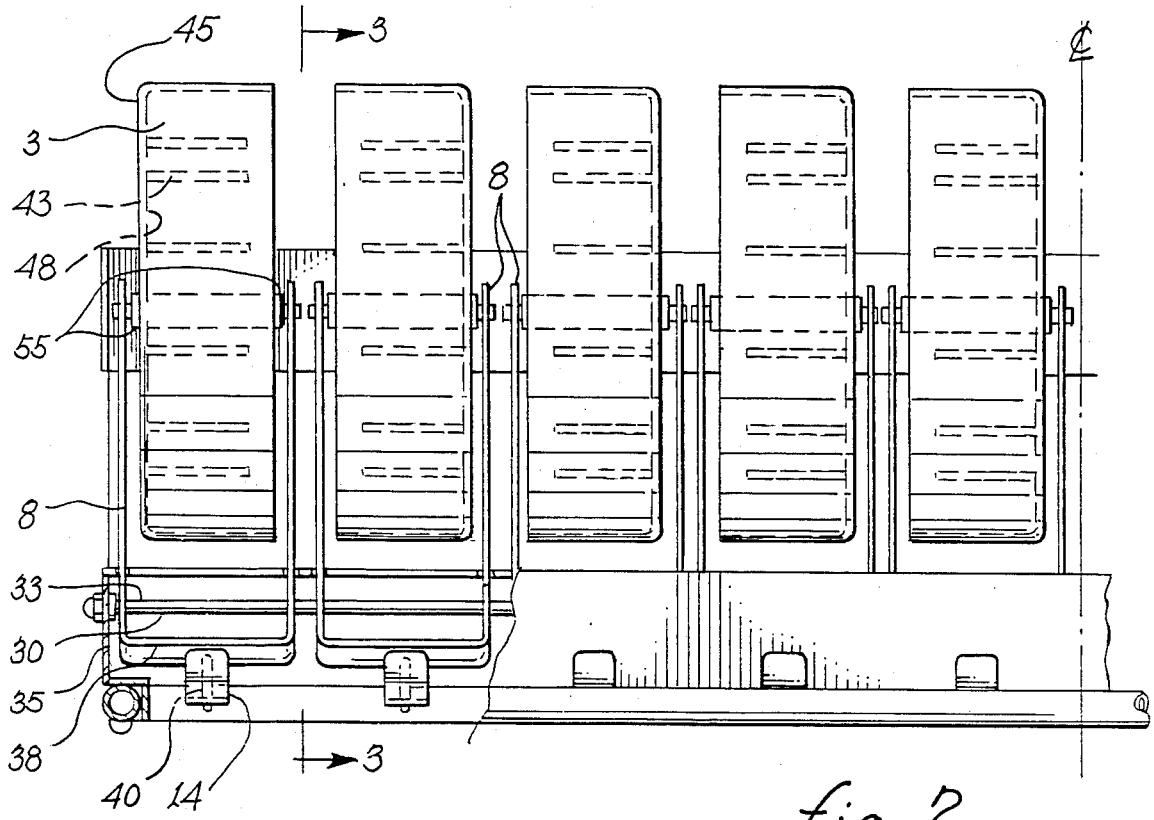
FIG. 2 is a sectional view of the improved threaded spool storage container apparatus of the present invention showing the manner in which a base member means for housing a stabilizer member means for operably coupling with a plurality of lever member means for removably mounting a plurality of containers which houses therein a plurality of threaded spools.

In FIG. 2, a sectional view of the improved threaded spool storage container apparatus 1 illustrating therein the manner in which a stabilizer member means 30 operably couples to the plurality of the arm members 8. The bottom portion of each arm member 8 has an aperture 33 passing therethrough to accommodate thereto said stabilizer member means 30. Each end of the stabilizer member means 30 is preferably coupled to each opposing side 35 of the base member means by a nut and bolt combination, rivets or the like. Each pair of adjustable arm members 8 are integrally joined at member 38 for coupling thereto to a vertically protruding member 40. The vertically protruding member 40 operably couples to the lever member means 14 for operating the pair of adjustable arm members 38 for outwardly and inwardly moving the container 3. Each threaded spool 5 (see also FIG. 1, supra.) stored in the container 3 is accommodated therein by a horizontal protruding member 43 extending therefrom at least one closed side 45 of the container 3. The horizontal protruding member 43 is preferably molded thereto the inside surface 48 of the closed side 45. A centrally located elongated member 50 extends across the container 3 wherein both ends 55 extend beyond the width of the container 3 to allow said ends 55 to be mounted on the adjustable arm members 8 having at end portion 55 a slotted section for accommodating said ends 55. At least one of said ends 55 is integrally coupled to the central portion of the closed side 45 of the container 3.

Figure 3:
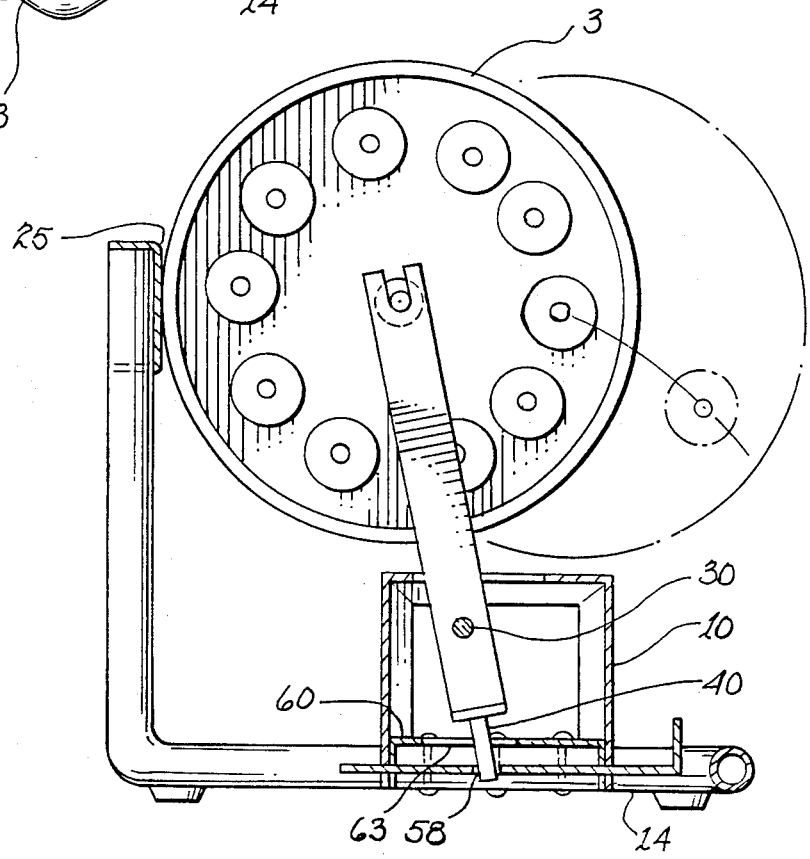
FIG. 3 is a cross sectional view of the improved threaded spool storage container apparatus of the present invention taken along line 3—3 of FIG. 2 showing the manner in which a lever member means operates a container for moving inwardly or outwardly to allow retrieval and removal of desired threaded spools.

As shown in FIG. 3, the lever member means 14 has an aperture 58 to accommodate therein the vertically protruding member 40 for operably coupling thereto. Upon pulling or pushing said lever member means 14, the adjustable arm members 8 (see also FIG. 1, supra.), integrally coupled to the vertically protruding member 40, are accordingly operably manipulated at either inward or outward direction. To allow a more stable guidance of said vertically protruding member 40, an internal guide plate 60 having an elongated aperture 63 passing therethrough is internally coupled to the base member means 10. The elongated aperture 63 operably accommodates therein the upper portion of said vertically protruding member 40 to allow more stable guidance of the rotatable adjustable arm members 8 around the stabilizer member means 30 to permit thereby a smooth operation of the container 3 from an inward to an outward position or vice versa, as shown.

Figure 4:
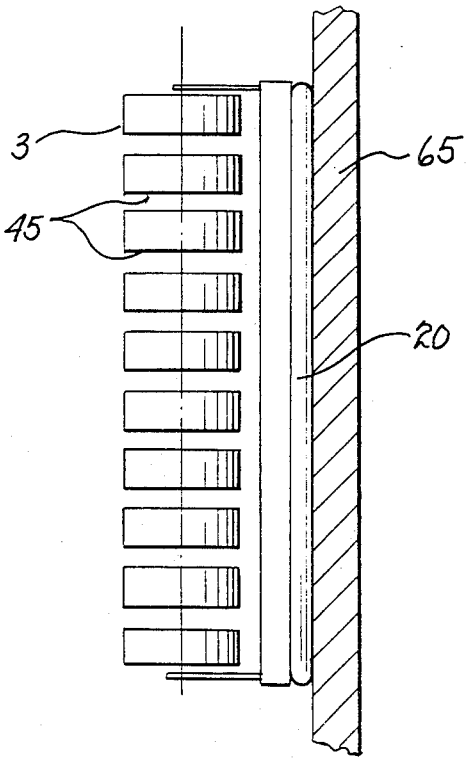
FIG. 4 is an elevational view showing the improved threaded spool storage container apparatus of the present invention suitable for incorporating therein a base member means suitable for vertically mounting onto a side wall member.
Figure 5:
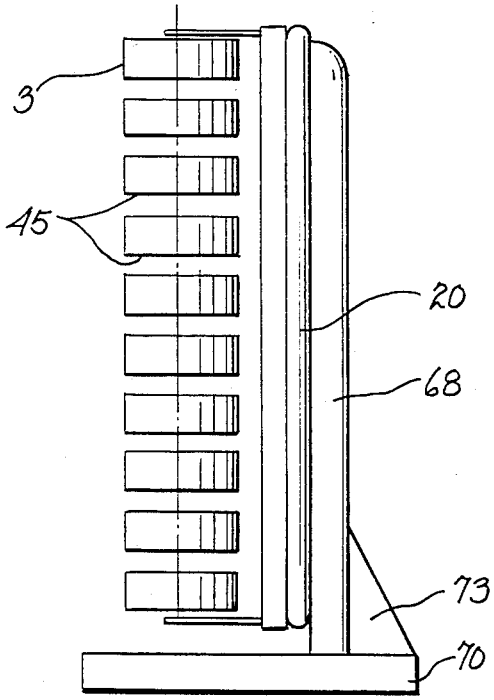
FIG. 5 is an elevational view illustrating the improved threaded spool storage container apparatus of the present invention suitable for incorporating therein another base member means for vertically standing the plurality of the threaded spool containers.

To allow accommodation of the improved threaded spool storage container apparatus 1 in a relatively space conscious position, the plurality of containers 3 may be positioned in a vertical series of positions as illustrated in FIGS. 4 and 5. In order to avoid spill of any of the threaded spools (not shown in FIGS. 4 and 5) from the containers 3, the closed side 45 is preferably at the bottom portion location for each container 3. As shown in FIG. 4, the bottom piece member 20, with or without the plurality of the support member means 28 (not shown in FIGS. 4 and 5) integrally coupled thereto, may be connected to a side wall member 65 by any desired attaching means (not shown). Similarly, as illustrated in FIG. 5, a vertically extending member means 68 for attaching to the bottom piece member 20 may be provided for integrally coupling to a horizontally extending base member 70. To allow rigidity and stability in the combination of the integrally coupled vertically 68 and horizontally 70 extending member means when in use, an intermediate support member means 73 is integrally coupled therebetween.

While the invention has been particularly shown and described in reference to preferred embodiments thereof, it will be understood by those skilled in the art that changes in form and details may be made without departing from the spirit and scope of the invention.

I claim:

1. An improved threaded spool container apparatus, comprising:

at least one container means for housing a plurality of threaded spools;

at least one adjustable arm member means for mounting said container means;

a base member means having a plurality of apertures therethrough for accommodating therein said adjustable arm member means;

at least one lever member means for operably coupling with said adjustable arm member means;

a bottom piece member means for coupling to said base member means; and a plate member means for integrally coupling to said bottom piece member means.

2. The improved threaded spool container apparatus as in claim 1 wherein said container is a transparent plastic material.

3. The improved threaded spool container apparatus as in claim 1 wherein said base member means is made of a rigid walled material such as a hard plastic or metal.

4. The improved threaded spool container apparatus as in claim 1 wherein said apertures passing therethrough said base member means is suitable for holding said arm member means when pulled in the outward direction.

5. The improved threaded container apparatus as in claim 1 wherein said apertures passing therethrough said base member means is suitable for holding said arm member means when pushed in the inward direction.

6. The improved threaded container apparatus as in claim 1 wherein said plate member means is for bracing said container means.

7. A method for storing a plurality of threaded spools, comprising the steps of:

placing a plurality of threaded spools into a container means;

mounting said container means onto at least a pair of adjustable arm member means which are moveably mounted thereabove a base member means;

inwardly pushing said container means into a plate member means suitable for bracing said container means;

outwardly pulling said container means which is mounted on said adjustable arm member means; and thereafter rotating said container means for retrieval of the desired threaded spools while said container means is in at outwardly position.

8. An improved threaded spool container apparatus, comprising:

at least one container means for housing a plurality of threaded spools;

at least one adjustable arm member means for removably mounting said container means;

a base member means having a plurality of apertures therethrough for accommodating therein said adjustable arm member means;

at least one lever member means for operably coupling with said adjustable arm member means;

a bottom piece member means for coupling to said base member means; and a plate member means integrally coupled to said bottom piece member means for bracing said container means.

* * * * *